US011620925B2

(12) United States Patent
Johnston et al.

(10) Patent No.: US 11,620,925 B2
(45) Date of Patent: Apr. 4, 2023

(54) MODULAR SPLIT AND/OR FLAP DISPLAYS AND ASSOCIATED INTERFACES AND COMMUNICATIONS

(71) Applicant: Vestaboard, Inc., Menlo Park, CA (US)

(72) Inventors: Andrew Johnston, Redwood City, CA (US); Faiza Hassan, Fairbanks, AK (US); Dorrian Porter, Menlo Park, CA (US); Ian Guyer, San Carlos, CA (US); Fred Bould, Menlo Park, CA (US); Kwan Hon Anson Cheung, San Francisco, CA (US); Brian Huppi, San Francisco, CA (US); Andrea Mucignat, San Francisco, CA (US)

(73) Assignee: VESTABOARD, INC., Menlo Park, CA (US)

( * ) Notice: Subject to any disclaimer, the term of this patent is extended or adjusted under 35 U.S.C. 154(b) by 310 days.

(21) Appl. No.: 16/819,975

(22) Filed: Mar. 16, 2020

(65) Prior Publication Data

US 2020/0219426 A1 Jul. 9, 2020

Related U.S. Application Data

(63) Continuation of application No. 16/248,332, filed on Jan. 15, 2019, now Pat. No. 10,699,605.

(60) Provisional application No. 62/618,025, filed on Jan. 16, 2018.

(51) Int. Cl.
*G09F 11/06* (2006.01)

(52) U.S. Cl.
CPC ..... *G09F 11/06* (2013.01)

(58) Field of Classification Search
CPC ..... G09F 11/06; G04B 19/24386; G04C 17/0033; G04C 17/0025
See application file for complete search history.

(56) References Cited

U.S. PATENT DOCUMENTS

| | | | |
|---|---|---|---|
| 3,402,490 | A | 9/1968 | Goldman et al. |
| 4,215,511 | A | 8/1980 | Todokoro |
| 7,372,179 | B2 | 5/2008 | Chiang |
| 7,609,589 | B1 | 10/2009 | Sheu |

(Continued)

OTHER PUBLICATIONS

Non-Final Office Action received for U.S. Appl. No. 16/248,332 dated Jun. 27, 2019, 25 pages.

*Primary Examiner* — Cassandra Davis
(74) *Attorney, Agent, or Firm* — Amin, Turocy & Watson, LLP

(57) ABSTRACT

Methods, devices, and split flap wheel apparatuses that can display alphanumeric characters, messages, and graphics are provided. For example, one or more embodiments described herein can comprise a split flap wheel apparatus, comprising: a housing adapted to rotate about a center axis; flaps hingeably coupled, via hinges, to the housing that rotate externally to the housing with rotation of the housing; and a motor disposed within the housing that drives the rotation of the housing. One or more embodiments described herein can comprise a device comprising: a housing with at least one opening; a wheel within the housing; a group of hinged flaps affixed to an outside surface of the wheel along a circumference of the wheel; and a motor disposed within the wheel that operates to spin the wheel by the fixed amount of angular rotation.

20 Claims, 10 Drawing Sheets

(56) References Cited

U.S. PATENT DOCUMENTS

| | | | | |
|---|---|---|---|---|
| 11,094,230 | B2 * | 8/2021 | Tenthorey | G09F 11/06 |
| 2017/0047832 | A1 * | 2/2017 | Dominguez Juarez | H02K 15/12 |

* cited by examiner

MODULAR SPLIT AND/OR FLAP DISPLAYS AND ASSOCIATED INTERFACES AND COMMUNICATIONS

RELATED APPLICATIONS

The subject patent application is a continuation of, and claims priority to each of, U.S. patent application Ser. No. 16/248,332 (now U.S. Pat. No. 10,699,605), filed Jan. 15, 2019, and entitled "Modular Split and/or Flap Displays and Associated Interfaces and Communications," which applications claim further priority to U.S. Provisional Patent Application No. 62/618,025, filed Jan. 16, 2018, and entitled "Modular Split and/or Flap Displays and Associated Interfaces and Communications," the entireties of which applications are hereby incorporated by reference herein.

TECHNICAL FIELD

The subject application relates generally to the field of informational signage and displays. More specifically, various embodiments comprise a system of mechanical units or modules that work together to replace digital signage or traditional signage.

BACKGROUND

In 1902, the 'Plato Clock' was patented, which used two sets of plates that would rotate to display the time by changing the numbers displayed on the plates. Commonly today this is called a 'flip clock.' Later, in the 1940s and 1950s, split-flap displays, also called 'flap displays' were introduced as an electromechanical display device that presents changeable alphanumeric text, and occasionally fixed graphics.

These 'flap displays' were often used as public transport timetables in airports or railway stations, as such they are often called Solari boards after display manufacturer Solari di Udine from Udine, Italy, or, in Central European countries, Pragotron after the Czech manufacturer. Recently, companies have introduced similar devices to social media platforms such as Flapit.

Existing displays are limited by the type of and nature of content that can be displayed on the units because they are either designed to work as an entire static unit, or they have been limited by their capacity to transfer power and information, and particularly over distances.

SUMMARY

The following presents a summary to provide a basic understanding of one or more embodiments of the disclosure. This summary is not intended to identify key or critical elements, or to delineate any scope of particular embodiments or any scope of the claims. Its sole purpose is to present concepts in a simplified form as a prelude to the more detailed description that is presented later. In one or more embodiments described herein, methods, devices, and/or split flap wheel apparatuses that can display alphanumeric characters, messages, and graphics are described.

According to one or more example embodiments, a method is provided. The method includes: driving a motor located within a wheel of a housing of the split flap wheel module, resulting in a drive output; and, in response to the drive output of the motor, rotating the wheel about an axis according to a fixed angular increment, to move a first pair of split flaps of the split flap wheel module from being on display to a second pair of split flaps on display, wherein each of the split flaps comprise a top portion of an alphanumeric character, and a bottom portion of a different alphanumeric character, and wherein the motor is configured to rotate the wheel by the fixed angular increment to cause: a previously displayed top split flap of the first pair of split flaps, which displayed a top portion of a first alphanumeric character of the previously displayed top split flap, to rotate with the fixed angular increment to become a currently displayed bottom split flap, which displays a bottom portion of a second alphanumeric character different from the first alphanumeric character as a result of the previously displayed top split flap rotating to the currently displayed bottom split flap, a previously hidden from view split flap of the second pair of split flaps, hidden behind the previously displayed top split flap, to rotate with the fixed angular increment to become a currently displayed top split flap that displays a top portion of the second alphanumeric character, and a previously displayed bottom split flap to rotate with the fixed angular increment to make room for the currently displayed bottom split flap to display the bottom portion of the second alphanumeric character.

According to an embodiment, a device is provided. The device can include a housing with at least one opening; a wheel within the housing, wherein the wheel is configured to spin about an axis, and wherein the wheel comprises a group of inward-facing gear teeth; a group of hinged flaps affixed to an outside surface of the wheel along a circumference of the wheel, wherein each hinged flap of the group of hinged flaps comprises a top half alphanumeric character and a bottom half alphanumeric character on opposing sides of the hinged flap, wherein a first pair of hinged flaps of the group of hinged flaps are exposed via the at least one opening for external viewing, wherein the first pair of the hinged flaps respectively show a top half of a first alphanumeric character and a bottom half of the first alphanumeric character together showing the first alphanumeric character in full, wherein, when the wheel spins about the axis for a fixed amount of angular rotation, the first pair of the hinged flaps change to a second pair of hinged flaps of the group of hinged flaps, and wherein the second pair of the hinged flaps respectively show a top half of a second alphanumeric character different than the first alphanumeric character and a bottom half of the second alphanumeric character together showing the second alphanumeric character in full; and a motor disposed within the wheel that operates to spin the wheel by the fixed amount of angular rotation. In at least one embodiment, the motor of the device comprises a solenoid.

According to yet one or more example embodiments, a split flap wheel apparatus is provided. The split flap wheel apparatus can include a housing adapted to rotate about a center axis; flaps hingeably coupled, via hinges, to the housing that rotate externally to the housing with rotation of the housing; and a motor disposed within the housing that drives the rotation of the housing, wherein each of the flaps comprise a top portion of an alphanumeric character on a first side of the flap, and a bottom portion of a different alphanumeric character on a second side of the flap opposite the first side, wherein the motor is configured to cause a fixed amount of the rotation of the housing, and wherein the rotation by the fixed amount causes a previously displayed top split flap of the flaps, which displayed a top portion of a first alphanumeric character of the previously displayed top split flap, to rotate with the defined amount of the rotation of the housing to become a currently displayed bottom split flap, which displays a bottom portion of a second alphanumeric character different from the first alphanumeric character as a result of the previously displayed top split flap flipping to the currently displayed bottom split flap, wherein a previously hidden split flap, hidden behind the previously displayed top split flap, rotates with the defined amount of the rotation of the housing to become a currently displayed top split flap that displays a top portion of the second alphanumeric character, and wherein a previously displayed bottom split flap rotates with the defined amount of the rotation of the housing to yield space for the currently displayed bottom split flap to display the bottom portion of the second alphanumeric character.

The foregoing has outlined rather broadly the more pertinent and key features of the method, device, and split flap wheel apparatus herein so that the detailed description of the present application that follows may be better understood and so the method, device, and split flap wheel apparatus's present contribution to the art can be more fully appreciated. Additional features of the method, device, and split flap wheel apparatus will be described hereinafter. It should be appreciated by those skilled in the art that the disclosed specific method, device, and split flap wheel apparatus may be readily utilized as a basis for modifying or designing other structures for obtaining the same purposes of the method, device, and split flap wheel apparatus herein. It should be realized by those skilled in the art that such equivalent methods, devices, and split flap wheel apparatuses do not depart from the spirit and scope of the method, device, and split flap wheel apparatus herein.

In this respect, before explaining at least one embodiment of the method, device, and split flap wheel apparatus herein in detail, it is to be understood that the method, device, and split flap wheel apparatus are not limited in their application to details of construction and to arrangements of components set forth in the following description or illustrated in the drawings. The method, device, and split flap wheel apparatus are capable of other embodiments, and of being practiced and performed in various ways. Also, it is to be understood that phraseology and terminology employed herein are for a purpose of description and should not be regarded as limiting.

As such, those skilled in the art will appreciate that the conception, upon which this disclosure is based, may readily be utilized as a basis for designing of other structures, methods and systems for obtaining the several purposes of the method, device, and split flap wheel apparatus herein.

DETAILED DESCRIPTION

Figure 1:
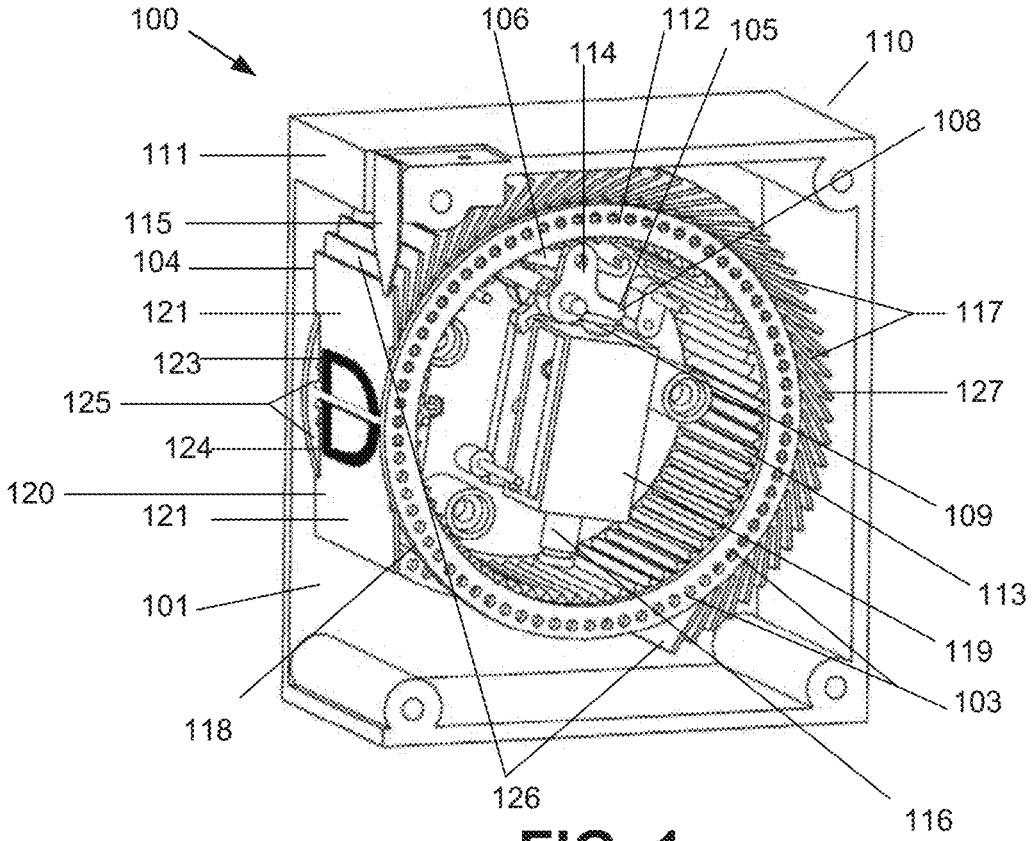
FIG. 1 illustrates a perspective view of the device, in accordance with disclosed embodiments.

The following detailed description is merely illustrative and is not intended to limit embodiments and/or application or uses of embodiments. Furthermore, there is no intention to be bound by any expressed or implied information presented in the preceding Background or Summary sections, or in the Detailed Description section.

One or more embodiments are now described with reference to the drawings, wherein like referenced numerals are used to refer to like elements throughout. In the following description, for purposes of explanation, numerous specific details are set forth in order to provide a more thorough understanding of the one or more embodiments. It is evident, however, in various cases, that the one or more embodiments can be practiced without these specific details.

As mentioned, various embodiments are described herein of a method, device, and split flap wheel apparatus that displays alphanumeric characters, messages, and/or graphics. As a system of units or modules, the display is more flexible to display and show a wide range of text, art, photographs, and other types of content, and be dynamically changed, as well as have modules added, subtracted or substituted. In addition, the size and use case for the display is made much more varied. By creating a modular system of interconnected units, each of which can be uniquely designed based on colors, size, text, and other shapes, and by connecting one or more of the units to sources of digital content, a greater range of displays can be created. For example, the split flap wheel apparatus can comprise a housing adapted to rotate about a center axis, flaps hingeably coupled to the housing that rotate externally to the housing with rotation of the housing, and a motor disposed within the housing that drives the rotation of the housing.

The device can comprise a housing with at least one opening; a wheel within the housing, wherein the wheel is configured to spin about an axis, and wherein the wheel comprises a group of inward-facing gear teeth; a group of hinged flaps affixed to an outside surface of the wheel along a circumference of the wheel, wherein each hinged flap of the group of hinged flaps comprises a top half alphanumeric character and a bottom half alphanumeric character on opposing sides of the hinged flap, wherein a first pair of hinged flaps of the group of hinged flaps are exposed via the at least one opening for external viewing, wherein the first pair of the hinged flaps respectively show a top half of a first alphanumeric character and a bottom half of the first alphanumeric character together showing the first alphanumeric character in full, wherein, when the wheel spins about the axis for a fixed amount of angular rotation, the first pair of the hinged flaps change to a second pair of hinged flaps of the group of hinged flaps, and wherein the second pair of the hinged flaps respectively show a top half of a second alphanumeric character different than the first alphanumeric character and a bottom half of the second alphanumeric character together showing the second alphanumeric character in full; and a motor disposed within the wheel that operates to spin the wheel by the fixed amount of angular rotation. In at least one embodiment, the motor of the device comprises a solenoid.

In this regard, and now referring to FIG. 1, a perspective view 100 of the device 110 is illustrated. In this example embodiment, the device 110 comprises: a housing 111 with an opening 101 on one side of the housing 112, a wheel 112 movably affixed inside the housing 111, wherein the wheel 112 is configured to rotate (rotation not pictured), and wherein the wheel 112 comprises a group of inward-facing gear teeth 113, a group of hinged flaps 117 affixed to the outside surface 118 of the wheel 112 via hinges 103, wherein the group of hinged flaps 117 comprises sets of hinged flaps 126 with a top half 121 and a bottom half 122, and the top half 121 of each individual hinged flap 127 contains the top half of an alphanumeric character 123 and a bottom half of a different alphanumeric character 124 on opposing sides of the hinged flap 127, wherein one set of hinged flaps 126 of the group of hinged flaps 117 is displayed 104 via the opening 101 of the housing 111, wherein the displayed set of hinged flaps 120 combines to form one completed alphanumeric character 125, wherein, when the wheel 112 rotates (rotation not pictured), the displayed set of the hinged flaps 120 changes to a different set of hinged flaps 126 of the group of hinged flaps 117, a motor 119 affixed inside the wheel 112 that operates to rotate (rotation not pictured) the wheel 112, wherein the motor 119 comprises at least two cylinders (not pictured) affixed to the inner surface of the wheel 112, at least two coils of wire (not pictured) wound around the at least two cylinders (not pictured), wherein the at least two coils of wire (not pictured) produce a magnetic field in response to an electric current applied to the at least two coils of wire (production of magnetic field and electric current not pictured), a stabilizer 115 movably affixed to the housing 111 that holds a top portion of the displayed set of hinged flaps 120 upright when the wheel 112 is stationary, and a ratchet 114 movably affixed to the inward-facing gears 113, wherein the ratchet 114 comprises a first distal end 105 and a second distal end 106, wherein the first distal end 106 of the ratchet 114 is configured to lockably engage (lockable engagement not pictured) with at least one inward-facing gear tooth 113, wherein the second distal end 106 comprises a flat surface 108, and wherein the ratchet 114 prevents the wheel 112 from rotating (rotation not pictured) when the first distal end 105 is lockably engaged (lockable engagement not pictured) with the inward-facing gear teeth 113, and a rod 116 movably affixed inside the wheel 112, wherein a distal end 109 of the rod 116 aligns with the flat surface 108 of the second distal end 106 of the ratchet 114, wherein the motor 119 causes the rod 116 aligned with the flat surface 108 of the second distal end 106 of the ratchet 114 to come into contact (contact not pictured) with the flat surface 108 causing the first distal end 105 of the ratchet 114 to disengage from the inward-facing gear teeth 113, allowing the wheel 112 to rotate (rotation not pictured).

Figure 2:
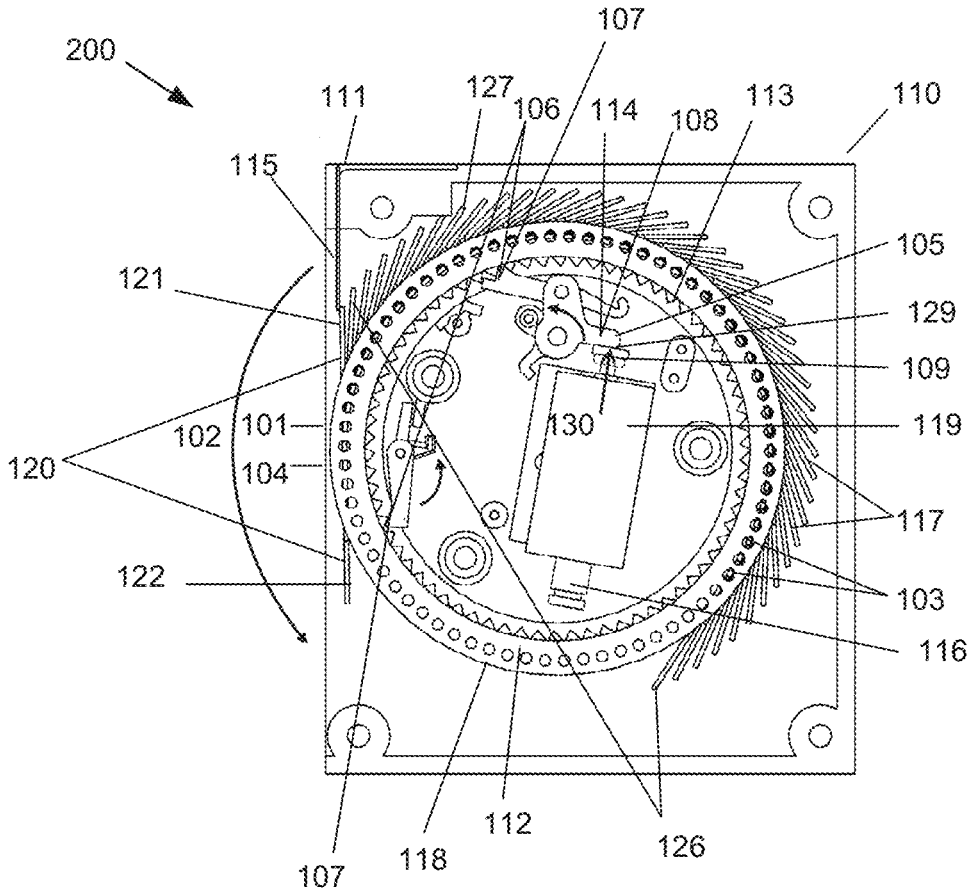
FIG. 2 illustrates a side view of the device, in accordance with disclosed embodiments.

Now referring to FIG. 2, a side view 200 of the device 110 is illustrated. In this example embodiment, the device 110 comprises: a housing 111 with an opening 101 on one side of the housing 112, a wheel 112 movably affixed inside the housing 111, wherein the wheel 112 is configured to rotate 102, and wherein the wheel 112 comprises a group of inward-facing gear teeth 113, a group of hinged flaps 117 affixed to the outside surface 118 of the wheel 112 via hinges 103, wherein the group of hinged flaps 117 comprises sets of hinged flaps 126 with a top half 121 and a bottom half 122, and the top half 121 of each individual hinged flap 127 contains the top half of an alphanumeric character (not pictured) and a bottom half of a different alphanumeric character (not pictured) on opposing sides of the hinged flap 127, wherein one set of hinged flaps 126 of the group of hinged flaps 117 is displayed 104 via the opening 101 of the housing 111, wherein the displayed set of hinged flaps 120 combines to form one completed alphanumeric character (not pictured), wherein, when the wheel 112 rotates 102, the displayed set of the hinged flaps 120 changes to a different set of hinged flaps 126 of the group of hinged flaps 117, a motor 119 affixed inside the wheel 112 that operates to rotate 102 the wheel 112, wherein the motor 119 comprises at least two cylinders (not pictured) affixed to the inner surface of the wheel 112, at least two coils of wire (not pictured) wound around the at least two cylinders (not pictured), wherein the at least two coils of wire (not pictured) produce a magnetic field in response to an electric current applied to the at least two coils of wire (production of magnetic field and electric current not pictured), and at least one voltage source component (not pictured) affixed to an inner surface of the wheel 112, a stabilizer 115 movably affixed to the housing 111 that holds a top portion of the displayed set of hinged flaps 120 upright when the wheel 112 is stationary, and a ratchet 114 movably affixed to the inward-facing gears 113, wherein the ratchet 114 comprises a first distal end 105 and a second distal end 106, wherein the first distal end 106 of the ratchet 114 is configured to lockably engage 107 with at least one inward-facing gear tooth 113, wherein the second distal end 106 comprises a flat surface 108, and wherein the ratchet 114 prevents the wheel 112 from rotating 102 when the first distal end 105 is lockably engaged 107 with the inward-facing gear teeth 113, and a rod 116 movably affixed inside the wheel 112, wherein a distal end 109 of the rod 116 aligns with the flat surface 108 of the second distal end 106 of the ratchet 114, wherein the motor 119 pushes or pulls 130 the rod 116 aligned with the flat surface 108 of the second distal end 106 of the ratchet 114 causing the rod 116 to come into contact 129 with the flat surface 108 causing the first distal end 105 of the ratchet 114 to disengage from the inward-facing gear teeth 113, allowing the wheel 112 to rotate 102.

Figure 3:
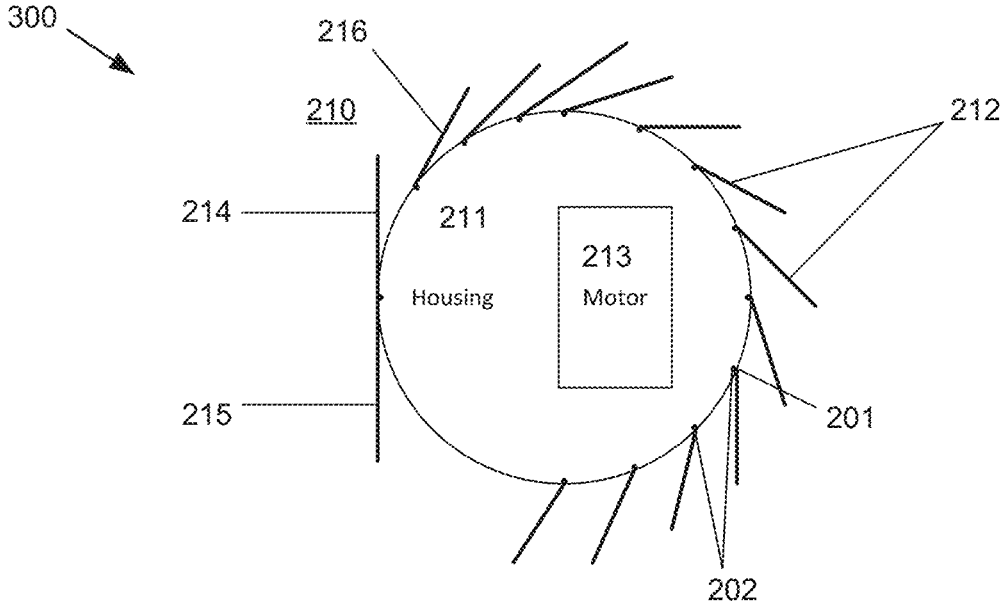
FIG. 3 illustrates a block diagram of the split flap wheel apparatus, in accordance with disclosed embodiments.

Now referring to FIG. 3, a block diagram 300 of the split flap wheel apparatus 210 is illustrated. In this example embodiment, the split flap wheel apparatus 210 comprises: a housing 211 adapted to rotate (rotation not pictured) about a center axis, flaps 212, hingeably coupled 201, via hinges 202, to the housing 211 that rotate (rotation not pictured) externally to the housing 211 with rotation (rotation not pictured) of the housing 211, and a motor 213 disposed within the housing 211 that drives the rotation (rotation not pictured) of the housing 211, wherein each of the flaps 212 comprise a top portion of an alphanumeric character (not pictured) on a first side of the flap (not pictured), and a bottom portion of a different alphanumeric character on a second side of the flap (not pictured) opposite the first side (not pictured), wherein the motor 213 is configured to cause a fixed amount of the rotation (rotation not pictured) of the housing 211, and wherein the rotation (rotation not pictured) by the fixed amount causes a previously displayed top split flap 216 of the flaps 112, which displayed a top portion of a first alphanumeric character (not pictured) of the previously displayed top split flap 216, to rotate (rotation not pictured) with the defined amount of the rotation (rotation not pictured) of the housing 211 to become a currently displayed bottom split flap 215, which displays a bottom portion of a second alphanumeric character (not pictured) different from the first alphanumeric character (not pictured) as a result of the previously displayed top split flap 216 flipping to the currently displayed bottom split flap 215, wherein a previously hidden split flap (not pictured), hidden behind the previously displayed top split flap 216, rotates (rotation not pictured) with the defined amount of the rotation (rotation not pictured) of the housing 211 to become a currently displayed top split flap 214 that displays a top portion of the second alphanumeric character (not pictured), and wherein a previously displayed bottom split flap (not pictured) rotates (rotation not pictured) with the defined amount of the rotation (rotation not pictured) of the housing 211 to yield space for the currently displayed bottom split flap 215 to display the bottom portion of the second alphanumeric character (not pictured).

Figure 4:
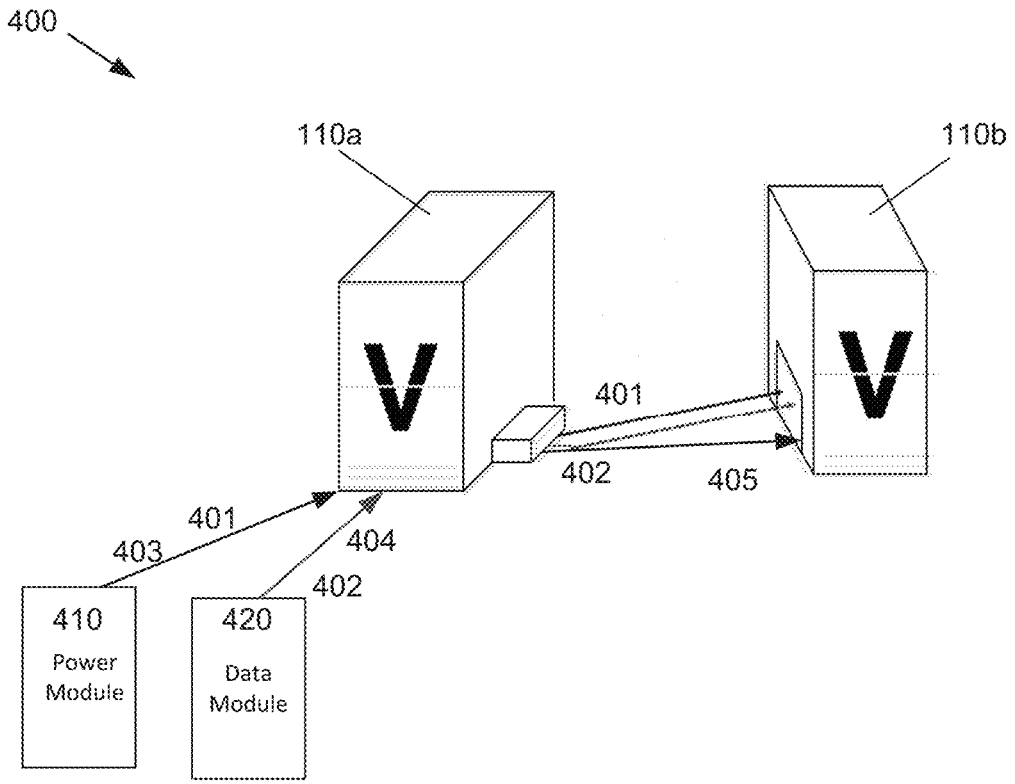
FIG. 4 illustrates a block diagram of an example implementation of the device, in accordance with disclosed embodiments.

Now referring to FIG. 4, a block diagram of an example implementation 400 of the device 110 is illustrated. In FIG. 4, the implementation 400 of the device 110 comprises the transfer of power 401 from a power module 410 to a device 110*a* via a physical connection 403 and/or the transfer of data 402 from a data module 420 to the device 110*a* via a physical connection 404, wherein the module to receive data 420 receives data from the cloud or other computer, and wherein the power and/or data is transferred from the device 110*a* to a device 110*b* via a physical connection 405. Alternatively, in another embodiment, the implementation 400 can be an implementation of at least one split flap wheel apparatus 210. In another embodiment, the implementation 400 can be an implementation of at least one split flap wheel apparatus 210 and at least one device 110. It should be noted that the physical connection 405 between device 110*a* and device 110*b* depicted in FIG. 4 is just one of several possible locations for a physical connection between the devices. In other embodiments the physical connection 405 can be located on the back panels of device 110*a* and device 110*b*. In yet another embodiment, the physical connection 405 between device 110*a* and device 110*b* can be facilitated by a connection to another object (such as a plate).

Figure 5:
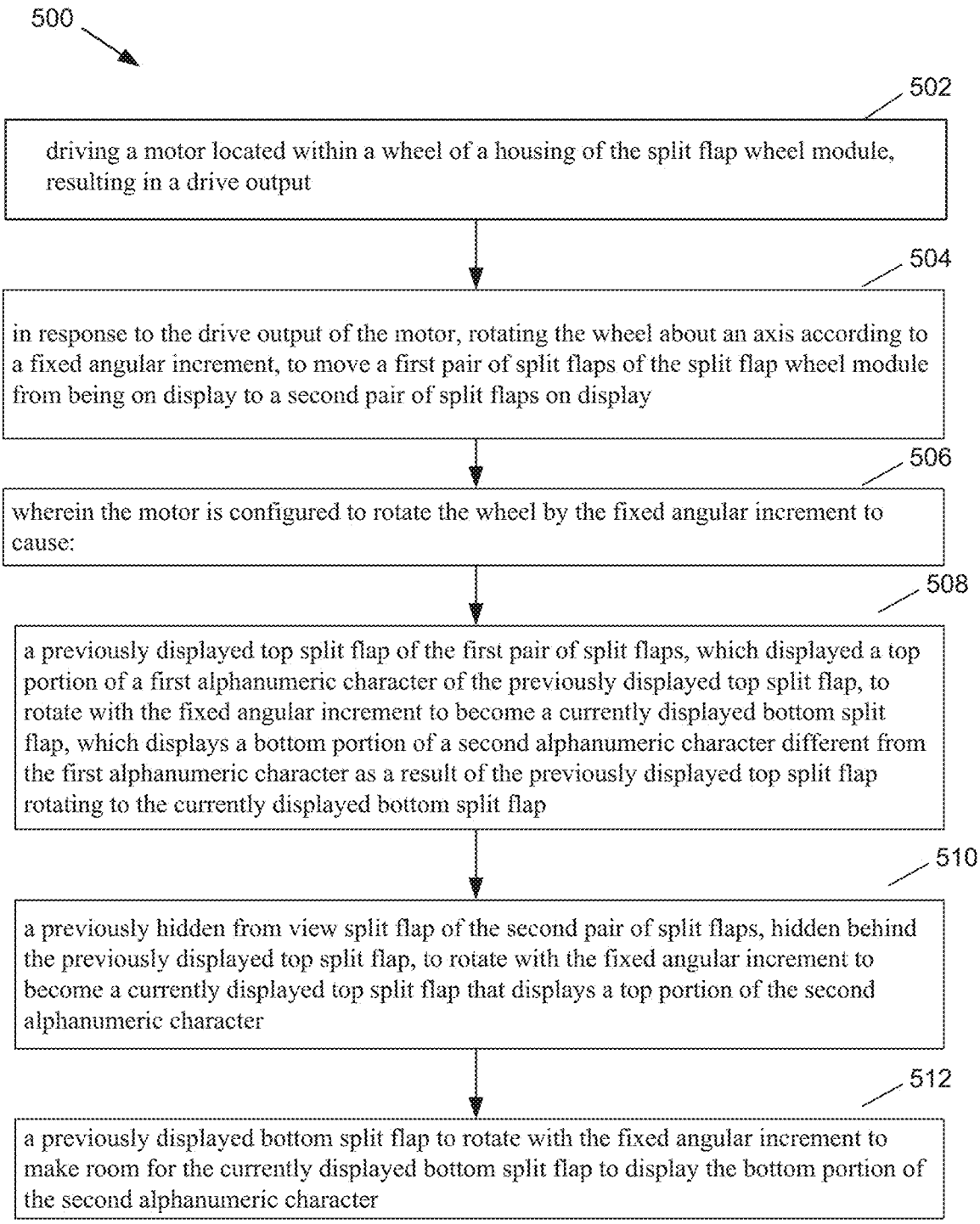
FIG. 5 illustrates a flowchart of an example method of operating a split flap wheel module, in accordance with disclosed embodiments.

Now referring to FIG. 5, a flowchart 500 of a method of operating a split flap wheel module is illustrated. The method comprising: 502 driving a motor located within a wheel of a housing of the split flap wheel module, resulting in a drive output, 504 in response to the drive output of the motor, rotating the wheel about an axis according to a fixed angular increment, to move a first pair of split flaps of the split flap wheel module from being on display to a second pair of split flaps on display, 506 wherein the motor is configured to rotate the wheel by the fixed angular increment to cause: 508 a previously displayed top split flap of the first pair of split flaps, which displayed a top portion of a first alphanumeric character of the previously displayed top split flap, to rotate with the fixed angular increment to become a currently displayed bottom split flap, which displays a bottom portion of a second alphanumeric character different from the first alphanumeric character as a result of the previously displayed top split flap rotating to the currently displayed bottom split flap, 510 a previously hidden from view split flap of the second pair of split flaps, hidden behind the previously displayed top split flap, to rotate with the fixed angular increment to become a currently displayed top split flap that displays a top portion of the second alphanumeric character, and 512 a previously displayed bottom split flap to rotate with the fixed angular increment to make room for the currently displayed bottom split flap to display the bottom portion of the second alphanumeric character.

Figure 6:
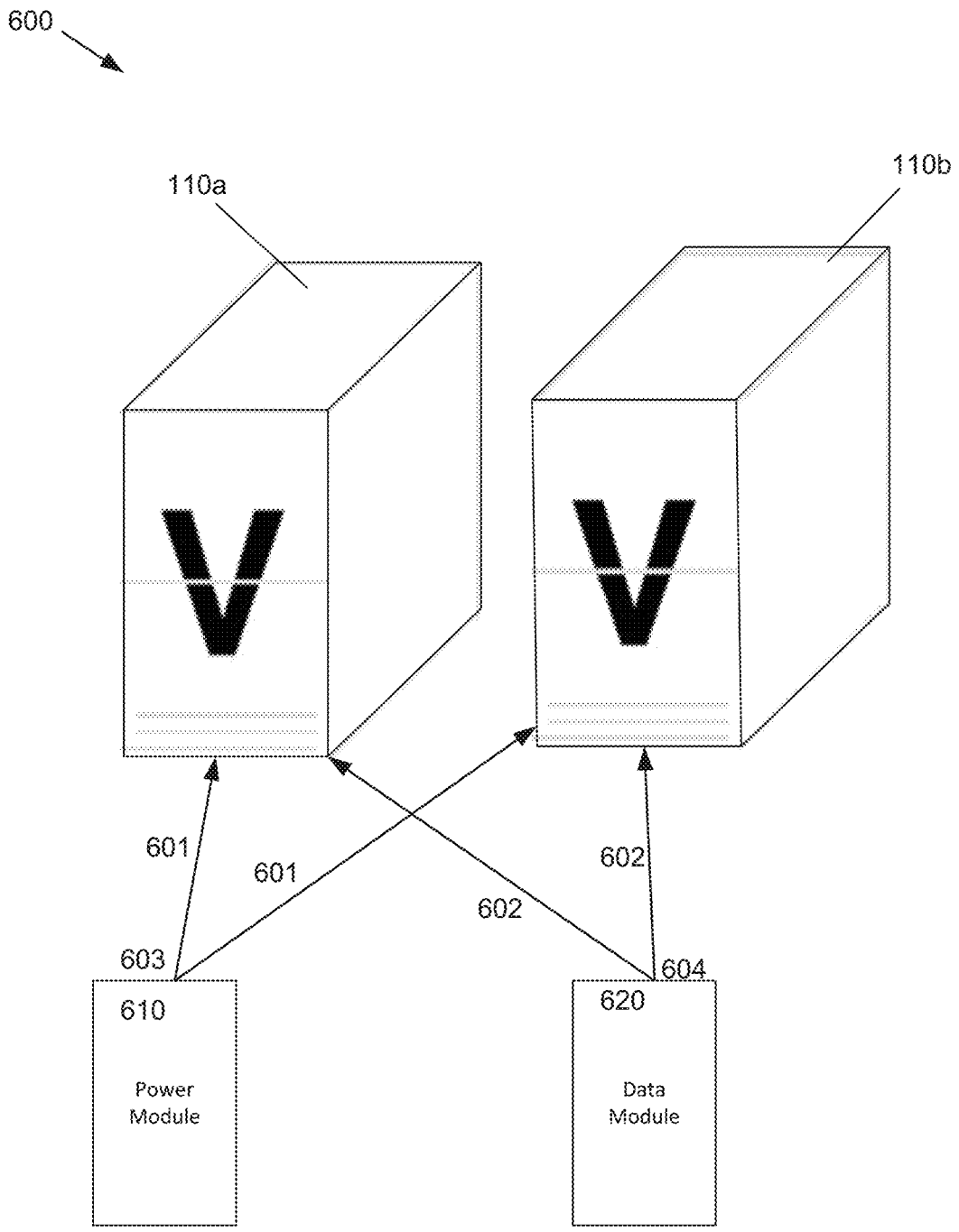
FIG. 6 illustrates a illustrates a block diagram of an example implementation of the split flap wheel apparatus, in accordance with disclosed embodiments.

Now referring to FIG. 6, a block diagram of an example implementation 600 of the device 110 is illustrated. In FIG. 6, the implementation 600 of the device 110 comprises the wireless transfer of power 601 from a module for wireless power 610 to a device 110*a* and device 110*b* via a wireless connection 603 and/or the wireless transfer of data 602 from a module to receive and send wireless data 620 to the device 110*a* and device 110*b* via a wireless connection 604, wherein the module to receive and send wireless data 620 receives data from the cloud or other computer. Alternatively, in another embodiment, the implementation 600 can be an implementation of at least one split flap wheel apparatus 210. In another embodiment, the implementation 600 can be an implementation of at least one split flap wheel apparatus 210 and at least one device 110.

Figure 7:
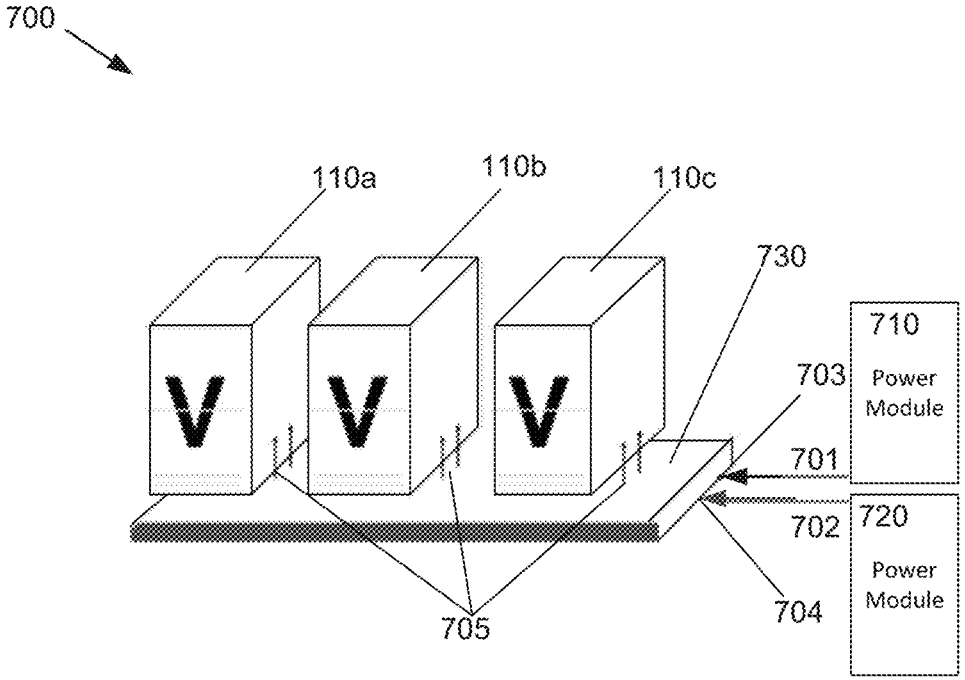
FIG. 7 illustrates a illustrates a block diagram of an example implementation of the split flap wheel apparatus, in accordance with disclosed embodiments.

Now referring to FIG. 7, a block diagram of an example implementation 700 of the device 110 is illustrated. In FIG. 7, the implementation 700 of the device 110 comprises the transfer of power 701 from a power module 710 to a plate 730 via a physical connection 703 and/or the transfer of data 702 from a data module 720 to the plate 730 via a physical connection 704, wherein the module to receive data 720 receives data from the cloud or other computer, and wherein the power and/or data is transferred from the plate 730 to a device 110*a*, a device 110*b*, and a device 110*c* via a physical connection 705. Alternatively, in another embodiment, the implementation 700 can be an implementation of at least one split flap wheel apparatus 210. In another embodiment, the implementation 700 can be an implementation of at least one split flap wheel apparatus 210 and at least one device 110.

Figure 8:
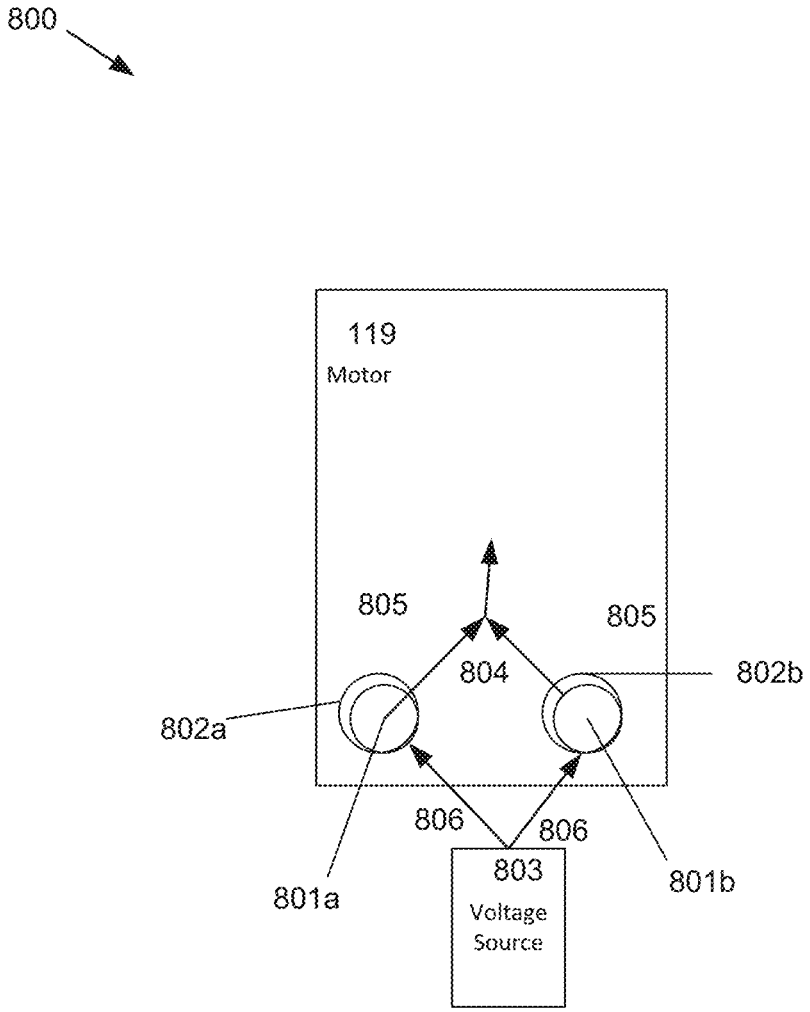
FIG. 8 illustrates a block diagram of the motor of the device, in accordance with disclosed embodiments.

Now referring to FIG. 8, a block diagram 800 of the motor 119 of the device 110 is illustrated. In this example embodiment, the motor 119 comprises: at least two cylinders (801*a* and 801*b*), at least two coils of wire (802*a* and 802*b*) wound around the at least two cylinders (801*a* and 801*b*), and at least one voltage source 803, wherein the at least two coils of wire (802*a* and 802*b*) produce a magnetic field 804 in response to an electric current 805 applied to the at least two coils of wire (802*a* and 802*b*), wherein the at least one voltage source 803 applies a voltage 806 across the at least two coils of wire (802*a* and 802*b*), wherein the voltage 806 generates the electric current 805 through the at least two coils of wire (802*a* and 802*b*) which produces the magnetic field 804 that facilitates driving of the motor 119.

Figure 9:
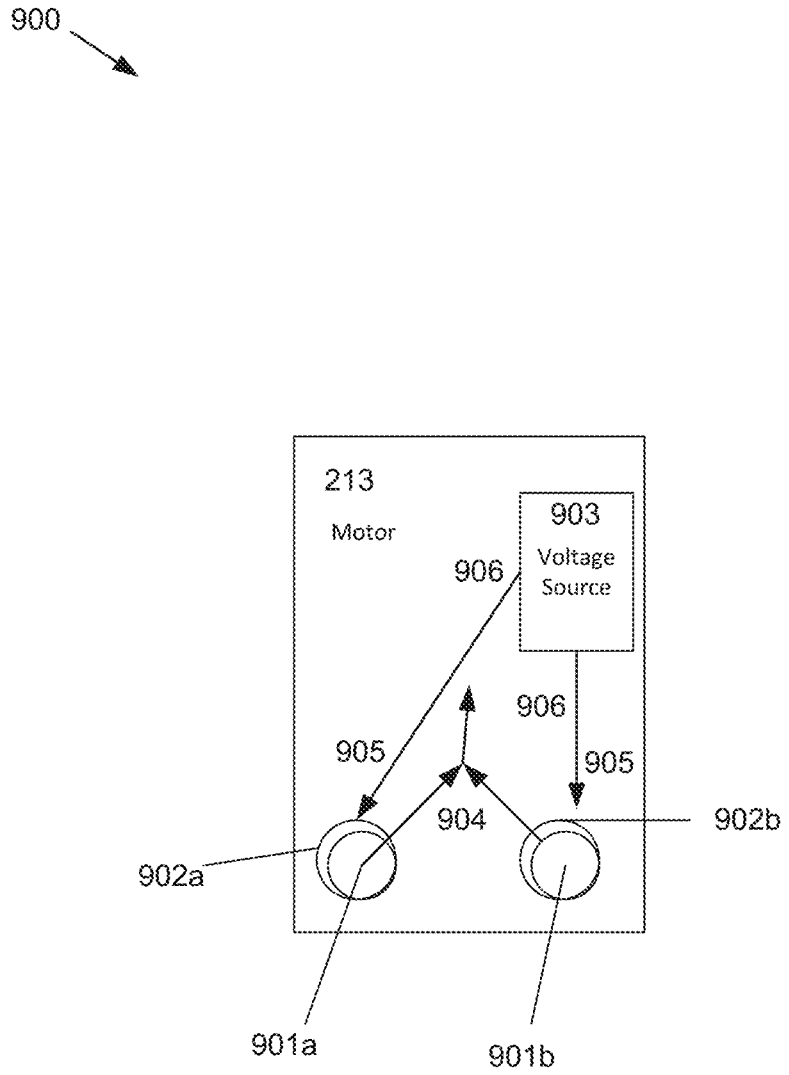
FIG. 9 illustrates a block diagram of the motor of the split flap wheel apparatus, in accordance with disclosed embodiments.

Now referring to FIG. 9, a block diagram 900 of the motor 213 of the split flap wheel apparatus 210 is illustrated. In this example embodiment, the motor 213 comprises: at least two cylinders (901*a* and 901*b*), at least two coils of wire (902*a* and 902*b*) wound around the at least two cylinders (901*a* and 901*b*), and at least one voltage source 903, wherein the at least two coils of wire (902*a* and 902*b*) produce a magnetic field 904 in response to an electric current 905 applied to the at least two coils of wire (902*a* and 902*b*), wherein the at least one voltage source 903 applies a voltage 906 across the at least two coils of wire (902*a* and 902*b*), wherein the voltage 906 generates the electric current 905 through the at least two coils of wire (902*a* and 902*b*) which produces the magnetic field 904 that facilitates driving of the motor 213.

Figure 10:
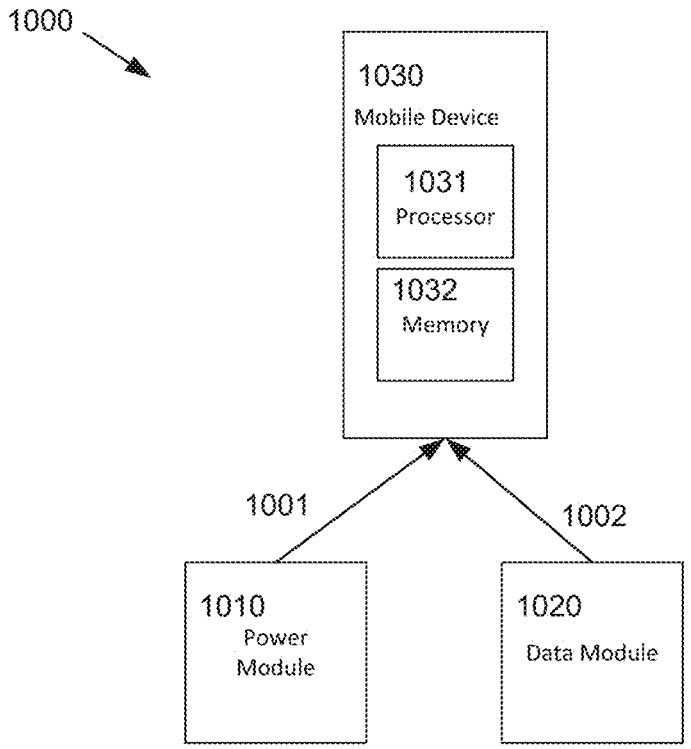
FIG. 10 illustrates a block diagram of an example computer implementation 1000 of the method of operating the split flap wheel module, in accordance with disclosed embodiments.

Now referring to FIG. 10, a block diagram of an example computer implementation 1000 of the method of operating the split flap wheel module 210 is illustrated. In FIG. 10, the computer implementation 1000 of the method of operating the split flap wheel module 210 comprises the transfer of power 1001 from a power module 1010 to a mobile device 1030 (such as a smart phone or a tablet computer) and/or the transfer of data 1002 from a data module 1020 to the mobile device, wherein the data module 1020 receives data from the cloud or other computer, wherein the mobile device 1030 comprises a processor 1031, operably coupled to a memory 1032, that can execute computer executable instructions comprising: driving a motor located within a wheel of a housing of the split flap wheel module, resulting in a drive output (not pictured), in response to the drive output of the motor, rotating the wheel about an axis according to a fixed angular increment, to move a first pair of split flaps of the split flap wheel module from being on display to a second pair of split flaps on display (not pictured), wherein the motor is configured to rotate the wheel by the fixed angular increment to cause: a previously displayed top split flap of the first pair of split flaps, which displayed a top portion of a first alphanumeric character of the previously displayed top split flap, to rotate with the fixed angular increment to become a currently displayed bottom split flap, which displays a bottom portion of a second alphanumeric character different from the first alphanumeric character as a result of the previously displayed top split flap rotating to the currently displayed bottom split flap (not pictured), a previously hidden from view split flap of the second pair of split flaps, hidden behind the previously displayed top split flap, to rotate with the fixed angular increment to become a currently displayed top split flap that displays a top portion of the second alphanumeric character (not pictured), and a previously displayed bottom split flap to rotate with the fixed angular increment to make room for the currently displayed bottom split flap to display the bottom portion of the second alphanumeric character (not pictured), and wherein the mobile device 1030 can execute the computer instructions in any of implementation 300, implementation 500, or implementation 600 discussed above.

Those skilled in the art will recognize that, unless specifically indicated or required by the sequence of operations, certain steps in the processes described above may be omitted, performed concurrently or sequentially, or performed in a different order.

Although an exemplary embodiment of the present disclosure has been described in detail, those skilled in the art will understand that various changes, substitutions, variations, and improvements disclosed herein may be made without departing from the spirit and scope of the disclosure in its broadest form.

Aspects of the present application are described herein with reference to flowchart illustrations and/or block diagrams of methods, apparatuses, and devices according to embodiments of the present application. It will be understood that each block of the flowchart illustrations and/or block diagrams, and combinations of blocks in the flowchart illustrations and/or block diagrams, can be implemented by computer readable program instructions.

These computer readable program instructions may be provided to a processor of a general purpose computer, special purpose computer, or other programmable data processing apparatus to produce a machine, such that the instructions, which execute via the processor of the computer or other programmable data processing apparatus, create means for implementing the functions/acts specified in the flowchart and/or block diagram block or blocks. These computer readable program instructions may also be stored in a computer readable storage medium that can direct a computer, a programmable data processing apparatus, and/or other devices to function in a particular manner, such that the computer readable storage medium having instructions stored therein comprises an article of manufacture including instructions which implement aspects of the function/act specified in the flowchart and/or block diagram block or blocks.

The computer readable program instructions may also be loaded onto a computer, other programmable data processing apparatus, or other device to cause a series of operational steps to be performed on the computer, other programmable apparatus or other device to produce a computer implemented process, such that the instructions which execute on the computer, other programmable apparatus, or other device implement the functions/acts specified in the flowchart and/or block diagram block or blocks.

The flowchart and block diagrams in the Figures illustrate the architecture, functionality, and operation of possible implementations of methods, apparatuses, and devices according to various embodiments in the present application. In this regard, each block in the flowchart or block diagrams may represent a module, segment, or portion of instructions, which comprises one or more executable instructions for implementing the specified logical function (s). In some alternative implementations, the functions noted in the blocks may occur out of the order noted in the Figures. For example, two blocks shown in succession may, in fact, be executed substantially concurrently, or the blocks may sometimes be executed in the reverse order, depending upon the functionality involved. It will also be noted that each block of the block diagrams and/or flowchart illustration, and combinations of blocks in the block diagrams and/or flowchart illustration, can be implemented by special purpose hardware-based systems that perform the specified functions or acts or carry out combinations of special purpose hardware and computer instructions.

What is claimed is:

1. A system, comprising:

an apparatus, the apparatus comprising:

a housing;

a wheel within the housing, wherein the wheel is configured to spin about an axis;

a group of split flaps hingeably disposed on an outer surface of the wheel, wherein the group of split flaps corresponds to a group of top section and bottom section pairs, each top section and bottom section pair operable to display a different defined representation of a group of different defined representations; and a motor disposed within the wheel that is operable to spin the wheel by different fixed amounts of angular rotation respectively corresponding to the group of different defined representations of the group of top section and bottom section pairs, the motor comprising a group of cylinders affixed to an inner surface of the wheel; and a data module, wherein the data module is communicatively connected to the apparatus, wherein the data module is configured to receive content from a data source, and wherein the data module stores executable instructions that, when executed by a processor, facilitate performance of operations, comprising:

based on the content received from the data source, determining to display a selected representation, of the group of different defined representations, corresponding to a selected top section and bottom section pair of a selected split flap of the group of top section and bottom section pairs of the group of split flaps; and commanding the apparatus to drive the motor, wherein the wheel spins about the axis for a fixed amount of angular rotation, of the different fixed amounts of angular rotation, corresponding to the selected top section and bottom section pair, the motor stopping when the wheel reaches the selected representation, wherein the commanding results in display of the selected top section and the bottom section pair of the selected split flap corresponding to the selected representation.

2. The system of claim 1, wherein the different defined representation comprises at least one of an alphanumeric character, a color, or a graphic.

3. The system of claim 1, wherein the data module is communicatively connected to an array of apparatuses, comprising the apparatus, and wherein the array of apparatuses comprises respective groups of split-flaps, comprising the group of split flaps.

4. The system of claim 3, wherein the operations further comprise determining an array of selected representations for display by the array of apparatuses, and wherein the data module is communicatively connected to the array of apparatuses in parallel to deliver a data signal to result in the array of apparatuses respectively displaying the array of the selected representations.

5. The system of claim 1, wherein the motor stopping the wheel comprises:

a ratchet movably affixed to an inward-facing gear tooth of a group of inward-facing gear teeth disposed on the inner surface of the wheel, the ratchet comprising a first distal end, and a second distal end, the first distal end lockably disengaged with the inward-facing gear tooth while the wheel spins about the axis for the fixed amount of angular rotation, and the first distal end lockably engaged with a subsequent inward-facing gear tooth to stop the wheel when the wheel reaches the selected representation.

6. The system of claim 5, wherein spinning of the wheel about the axis comprises:

the motor operating a rod, movably affixed inside the wheel, the rod comprising a third distal end, the third distal end aligned with a flat surface of the second distal end of the ratchet; and in response to the apparatus driving the motor, and the third distal end of the rod contacting the flat surface of the second distal end of the ratchet, disengaging the first distal end of the ratchet from the inward-facing gear tooth.

7. A method, comprising:

receiving, by a data module of an apparatus, the apparatus comprising a processor, from a user device, a command representative of an input to be displayed by a group of split flaps of the apparatus;

in response to the receiving the command, driving a motor located within a housing of the apparatus, resulting in a drive output, the motor comprising a group of cylinders affixed to an inner surface of the housing;

in response to the drive output of the motor, rotating the housing about an axis according to a fixed angular increment, to move a group of split flaps, hingeably disposed on an outer surface of the housing, wherein each split flap of the group of split flaps comprises a top section of a characteristic, and a bottom section of an additional characteristic; and in response to the moving the group of split flaps, rotating the housing about the axis with the fixed angular increment to move a previously displayed top split flap of the group of split flaps, which displays a top portion of a previous characteristic of the previously displayed top split flap of the group of split flaps, to become a currently displayed bottom split flap, which displays a bottom portion of a new characteristic different from the previous characteristic of the previously displayed top split flap, as a result of the previously displayed top split flap rotating to the currently displayed bottom split flap, and rotating the housing about the axis with the fixed angular increment to move a previously hidden split flap of the group of split flaps, hidden behind the previously displayed top split flap, to become a currently displayed top split flap, which displays a top portion of the new characteristic, wherein the currently displayed top split flap and the currently displayed bottom split flap become a currently displayed split flap.

8. The method of claim 7, wherein each of the characteristic, the additional characteristic, the previous characteristic, and the new characteristic comprises at least one of a color characteristic of a color, a text characteristic of alphanumeric text, or a graphical characteristic of a graphic.

9. The method of claim 7, wherein the apparatus is operatively coupled to a power module.

10. The method of claim 7, wherein the command comprises content from a data source.

11. The method of claim 10, wherein at least a portion of the content is portrayed by the new characteristic of the currently displayed split flap.

12. The method of claim 7, further comprising communicatively connecting to a group of apparatuses in parallel, the group of apparatuses comprising the apparatus.

13. The method of claim 7, further comprising receiving a group of commands in parallel, the group of commands comprising the command, from a group of user devices, the group of user devices comprising the user device.

14. A non-transitory machine-readable medium, comprising executable instructions that, when executed by a processor of a data module communicatively connected to an apparatus, facilitate performance of operations, comprising:

based on content received from a data source, determining to display a selected representation, of a group of different defined representations, corresponding to a selected top section and bottom section pair of a selected split flap of a group of top section and bottom section pairs of a group of split flaps, wherein the group of split flaps is hingeably disposed on an outer surface of a wheel, within a housing of the apparatus, configured to spin about an axis, wherein the group of split flaps corresponds to the group of top section and bottom section pairs, each top section and bottom section pair operable to display a different defined representation of the group of different defined representations, wherein a motor is disposed within the wheel that is operable to spin the wheel by different fixed amounts of angular rotation respectively corresponding to the group of different defined representations of the group of top section and bottom section pairs, wherein the data module is communicatively connected to an array of apparatuses in parallel to deliver a data signal to result in the array of apparatuses, comprising the apparatus, respectively displaying an array of selected representations, comprising the selected representation, and wherein the motor comprises at least two cylinders; and commanding the apparatus to drive the motor, wherein the wheel spins about the axis for a fixed amount of angular rotation, of the different fixed amounts of angular rotation, corresponding to the selected top section and bottom section pair, the motor stopping when the wheel reaches the selected representation, wherein the commanding results in display of the selected top section and the bottom section pair of the selected split flap corresponding to the selected representation.

15. The non-transitory machine-readable medium of claim 14, wherein the motor comprises a solenoid that propagates the fixed amount of angular motion.

16. The non-transitory machine-readable medium of claim 14, wherein each split flap of the group of split flaps comprises an alphanumeric text characteristic, or a color characteristic.

17. The non-transitory machine-readable medium of claim 14, wherein at least one cylinder of the at least two cylinders comprises a corresponding coil wire wrapped around at least a portion of the at least one cylinder.

18. The non-transitory machine-readable medium of claim 14, wherein the operations further comprise sending an instruction to the motor to spin the wheel by the fixed amount of angular motion resulting in the motor being driven to spin the wheel by the fixed amount.

19. The non-transitory machine-readable medium of claim 14, wherein the data module has an operable connection with a power module, and wherein the operable connection comprises a wireless connection.

20. The non-transitory machine-readable medium of claim 14, wherein respective representations of the array of selected representations the different defined representation respectively comprise at least one of an alphanumeric character, a color, or a graphic.

* * * * *